US006860785B2

(12) United States Patent
Vap

(10) Patent No.: US 6,860,785 B2
(45) Date of Patent: Mar. 1, 2005

(54) SELF-PROPELLED FIGURE

(75) Inventor: Rudolph D. Vap, Cincinnati, OH (US)

(73) Assignee: Vap Creative, Ltd., Cincinnati, OH (US)

( * ) Notice: Subject to any disclaimer, the term of this patent is extended or adjusted under 35 U.S.C. 154(b) by 0 days.

(21) Appl. No.: 10/167,410

(22) Filed: Jun. 13, 2002

(65) Prior Publication Data

US 2003/0232566 A1 Dec. 18, 2003

(51) Int. Cl.[7] ..... A63H 23/00
(52) U.S. Cl. ..... 446/153; 446/158; 446/330
(58) Field of Search ..... 446/158, 156, 446/155, 154, 153, 356, 353, 352, 330

(56) References Cited

U.S. PATENT DOCUMENTS

| | | | | |
|---|---|---|---|---|
| 2,645,883 | A | * 7/1953 | De Salvo | 446/158 |
| 2,648,935 | A | * 8/1953 | Nagel | 446/158 |
| 2,854,787 | A | * 10/1958 | Oberg | 446/158 |
| 2,990,645 | A | * 7/1961 | Polzin | 446/154 |
| 3,077,698 | A | * 2/1963 | Glass et al. | 446/158 |
| 3,628,286 | A | * 12/1971 | Mashahiro | 446/158 |
| 3,783,552 | A | * 1/1974 | Goldbach | 446/158 |
| 3,785,084 | A | 1/1974 | Aenishanslin | |
| 3,835,581 | A | * 9/1974 | Grieder | 446/158 |
| 4,301,615 | A | * 11/1981 | Ikeda | 446/356 |
| 4,536,985 | A | 8/1985 | Caviness | |
| 4,674,223 | A | 6/1987 | Pearce | |
| 4,687,456 | A | 8/1987 | Wang | |
| 4,713,037 | A | 12/1987 | Tong | |
| 4,832,650 | A | 5/1989 | Tong | |
| 5,194,029 | A | 3/1993 | Kinoshita | |
| 5,197,913 | A | 3/1993 | Suzuki | |
| 5,344,357 | A | 9/1994 | Lyczek | |
| 5,405,465 | A | 4/1995 | Horiuchi | |
| 5,775,022 | A | 7/1998 | Sumrall et al. | |
| 5,931,715 | A | 8/1999 | Chang | |
| 6,022,025 | A | 2/2000 | Chuang | |
| 6,138,604 | A | 10/2000 | Anderson et al. | |
| 6,179,683 | B1 | 1/2001 | Pell et al. | |

FOREIGN PATENT DOCUMENTS

| | | | | |
|---|---|---|---|---|
| JP | 2002-119772 A | * 4/2002 | ..... | A63H/23/10 |
| JP | 20020136776 | * 5/2002 | ..... | A63H/23/10 |

OTHER PUBLICATIONS

Jactoys LTD., Sea Turtle, Product No. 8743, copyright 2000.
Jactoys LTD., Butterfly Fish, Product No. 8854, copyright 2000.

* cited by examiner

*Primary Examiner*—Derris H. Banks
*Assistant Examiner*—Urszula M Cegielnik
(74) *Attorney, Agent, or Firm*—Cooley Godward LLP

(57) ABSTRACT

A figure that is configured to be propelled through a liquid. The figure including a torso, a flexible appendage coupled to the torso, and a drive configured to move the appendage with respect to the torso.

39 Claims, 10 Drawing Sheets

SELF-PROPELLED FIGURE

BACKGROUND OF THE INVENTION

This invention relates generally to a self-propelled toy figure, and in particular, to a water toy, such as, a fish or a sea turtle, that can traverse through a liquid, such as water.

Children generally enjoy toys that simulate animals. Children also generally enjoy toys that can be used in aqueous environments, such as pools or lakes. Thus, water toys that simulate animals have been developed.

Some conventional water toys that simulate animals include moving appendages that propel the toy through liquids. For example, some conventional water toys simulate fish and include moving tails that propel the fish though water. However, the appendages of these conventional water toys, do not have life-like motions.

SUMMARY OF THE INVENTION

A toy figure includes a torso, an appendage coupled to the torso, and a drive. The toy figure is configured to be placed in a liquid, such as water. The drive is configured to produce a force sufficient to move the appendage with respect to the torso. The appendage is configured to flex while the appendage is moving with respect to the torso. The relative motion and the flex of the appendage effectively propel the toy figure through the liquid and provide the appendage with life-like movements.

DETAILED DESCRIPTION

A toy figure includes a torso, an appendage coupled to the torso, and a drive. The toy figure is configured to be placed in a liquid, such as water. The drive is configured to produce a force sufficient to move the appendage with respect to the torso. The appendage is configured to flex while the appendage is moving with respect to the torso. The relative motion and the flex of the appendage effectively propel the toy figure through the liquid and provide the appendage with life-like movements.

Figure 1:
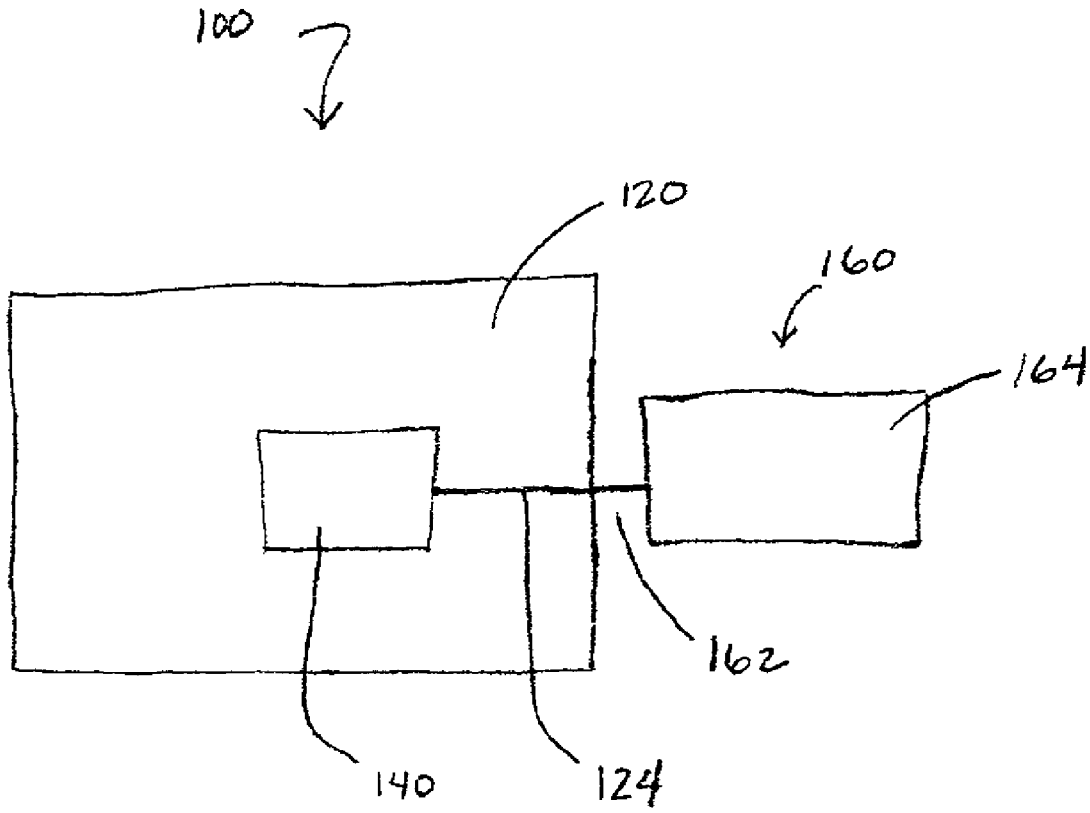
FIG. 1 is a schematic top view of a toy having a torso and a movable appendage according to an embodiment of the invention.

As illustrated schematically in FIG. 1, the toy figure 100 includes a torso 120, an appendage 160 coupled to the torso 120, and a drive 140 that is coupled to torso 120. A link 124, such as a drive shaft, operatively couples the drive 140 to the appendage 160. Drive 140 generates a force that is sufficient to move the appendage 160 with respect to the torso 120. The relative motion can be any type of relative motion, such as reciprocating pivotal motion or reciprocating linear motion. The appendage 160 includes a rigid portion 162 and a flexible portion 164.

The toy figure 100 can be configured to be placed in a liquid. The drive 140 is configured to move the appendage 160 with respect to the torso 120 when the toy figure is placed in the liquid. When the appendage 160 moves with respect to the torso 120, the flexible portion 164 of the appendage flexes or bends in a direction opposite to that of the movement of the appendage during at least a portion of the range of motion of the appendage. The motion of the appendage 160 with respect to the torso 120 and the flexing of the flexible portion 164 effectively propel the toy figure 100 through the liquid and give the toy figure 100 the appearance of realistic-looking motion.

Figure 2:
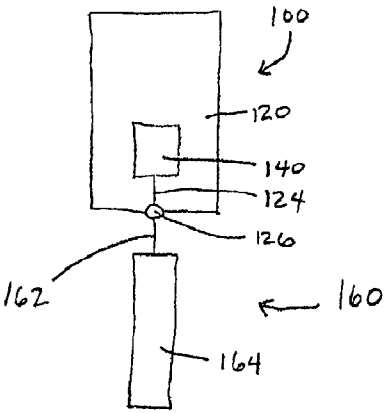
FIG. 2 is a schematic top view of the toy of FIG. 1 disposed in a liquid with the appendage in a rest position.
Figure 3:
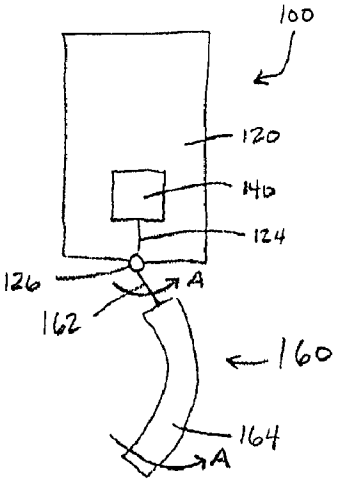
FIGS. 3–7 are schematic top views of the toy of FIG. 1 disposed in a liquid with the appendage moving.

FIG. 2 illustrates the toy figure 100 in a rest position. In this position, the appendage 160 is not moving with respect to the torso 120. FIGS. 3–7 illustrate the toy figure 100 disposed in a liquid at different stages of the relative movement between the torso 120 and the appendage 160. In this embodiment, the relative motion is a reciprocating pivotal motion with the appendage 160 pivoting about an axis 126 that is located at the rear of the torso. FIG. 3 shows the toy figure 100 in a first stage of the relative motion. In the first stage, the appendage 160 is pivoting in a first direction A with respect to the torso 120. As the appendage 160 pivots in the first direction A, both the flexible portion 164 and the rigid portion 162 of the appendage move in direction A. The flexibility of the appendage 160 and the resistance of the liquid, however, cause the flexible portion 164 of the appendage 160 to flex or bend in a direction opposite to that of the movement of the appendage.

Figure 4:
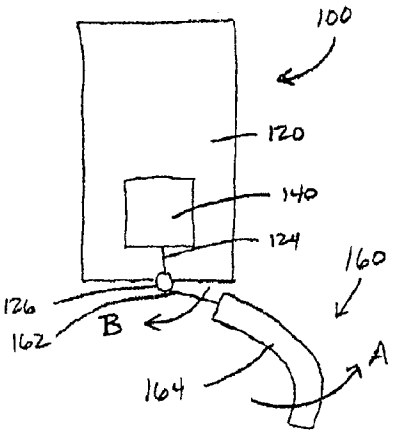
Figure 5:
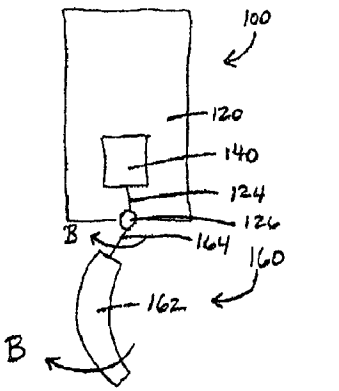

FIG. 4 shows the toy figure 100 in a second stage of the relative motion between the torso 120 and the appendage 160. In the second stage, the appendage 160 has reversed its direction and is pivoting in a second direction B with respect to the torso 120. The rigid portion 162 of the appendage 160 has also reversed its direction and is moving in the second direction B. The flexible portion 164 of the appendage 160, however, is still moving in the first direction A. In this second stage, the flexible portion 164 of the appendage 160 is flexing or bending in the same direction as that of the motion of at least a portion of the appendage. FIG. 5 shows the toy figure 100 in a third stage of the relative motion. In the third stage, the appendage 160 is still pivoting in the second direction B. The rigid portion 162 of the appendage 160 is also still moving in the second direction B. The flexible portion 164 of the appendage 160, however, has changed its direction and is moving in the second direction B. The flexible portion 164 of the appendage 160 is also flexing or bending in an direction opposite to that of the movement of the appendage.

Figure 6:
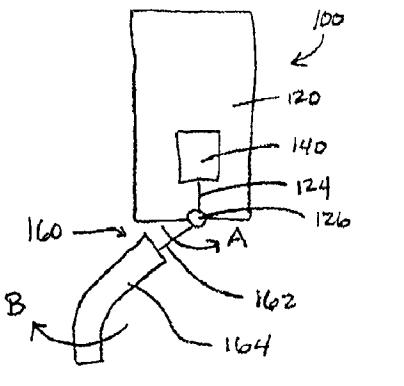
Figure 7:
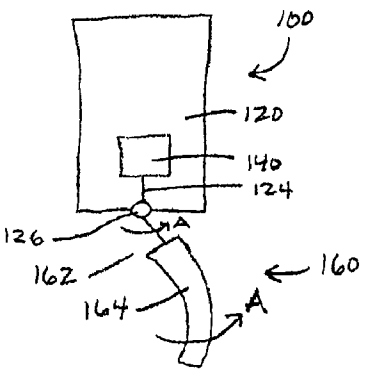
Figure 8:
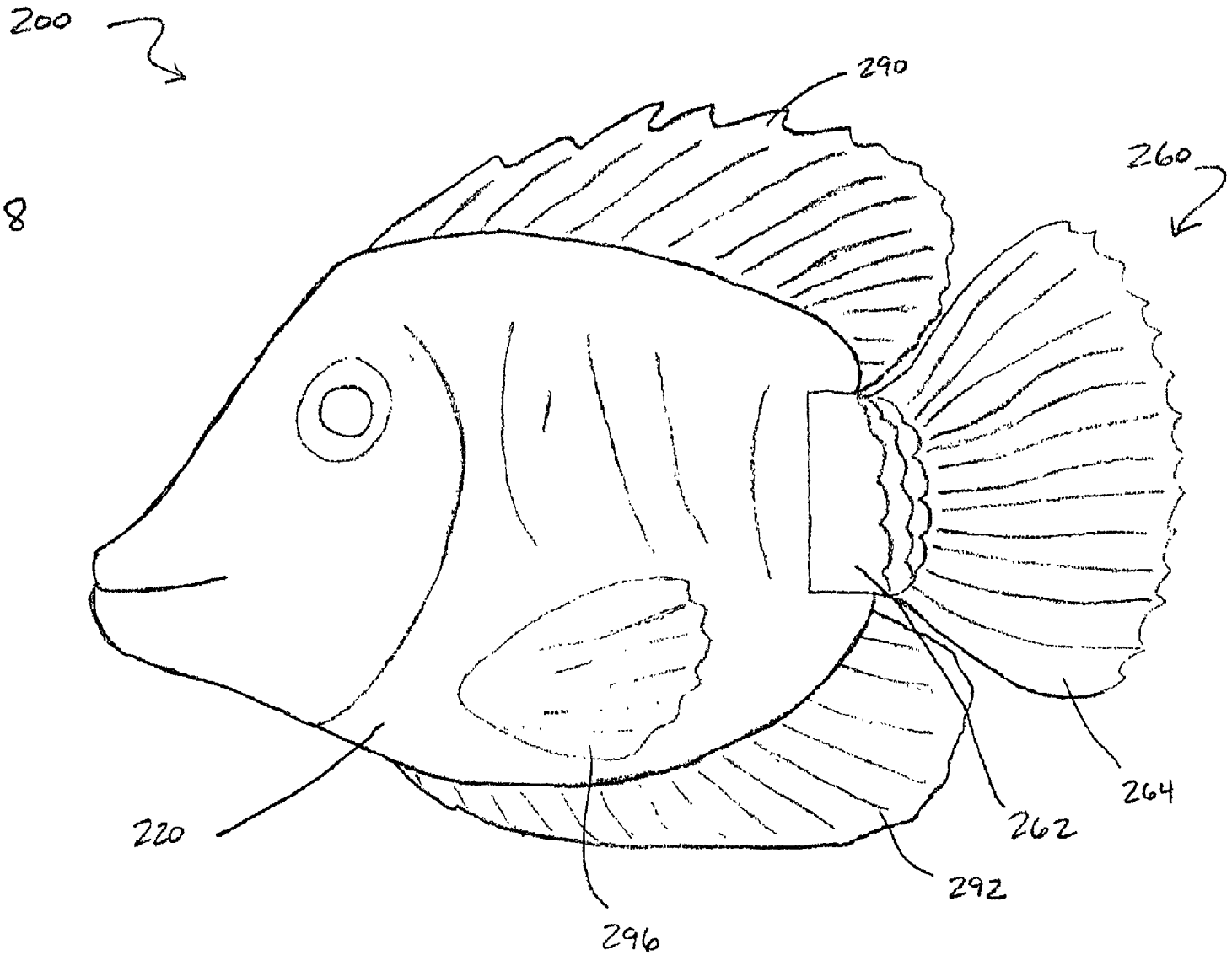
FIG. 8 is a side view of a toy reef fish according to an embodiment of the present invention.

FIG. 6 shows the toy figure 100 in a fourth stage of the relative motion between the torso 120 and the appendage 160. In the fourth stage, the appendage 160 has changed its direction and is again pivoting in the first direction A. The rigid portion 162 of the appendage 160 has also changed its direction and is again moving in the first direction A. The flexible portion 164 of the appendage 160, however, is still moving in the second direction B. In this fourth stage, the flexible portion 164 of the appendage 160 is flexing or bending in the same direction as that of the motion of at least a portion of the appendage. FIG. 7 shows the toy figure in a fifth stage of relative motion between the torso 120 and the appendage 160. In the fifth stage, the appendage is still pivoting in the first direction A. The rigid portion 162 is also still moving in the first direction A. The flexible portion 164 of the appendage 160, however, has changed its direction and is again moving in the first direction A. The flexible portion 164 of the appendage 160 is also flexing or bending in an direction opposite to that of the movement of the appendage.

Because the flexible portion 164 of the appendage 160 flexes and bends as the appendage 160 moves with respect to the torso 120, the movement of the flexible portion constantly lags the motion of the rigid portion 162 of the appendage. Thus, when the appendage 160 moves with respect to the torso 120 the appendage moves in a wave-like, whipping motion.

Although FIGS. 3–7 show the relative movement between the appendage 160 and the torso 120 as a pivotal motion rotating about the axis 126 that is located at the rear of the torso, it is not necessary that that the axis be located at a rear portion of the torso. In alternative embodiment, the axis of rotation is located at a front portion of the torso. In a further embodiment, the axis of rotation is located at a side portion of the torso.

In another embodiment, the appendage of the toy figure is configured such that the appendage flexes or bends in more than one direction when the appendage moves with respect to the torso. For example, the appendage may flex or bend in an "S" shape when the appendage moves with respect to the torso.

In another embodiment, the appendage does not include a rigid portion, rather the entire appendage is flexible.

An implementation of the invention described and illustrated schematically above is illustrated in FIGS. 8–12. In this embodiment, a toy reef fish 200 includes a torso 220 that simulates a fish torso and an appendage 260 that simulates a fish tail. The torso 220 of the toy reef fish 200 includes a surface that defines an enclosure or a cavity 222. As best viewed in FIG. 9, the cavity is the space located between the two molded halves 220*a* and 220*b* of the torso 220. In this embodiment, the molded halves 220*a* and 220*b* of the torso are made of acrylonitrile-butadiene-styrene plastic. In other embodiments, the molded halves of the torso are made of any other type of material that will retain the shape and configuration of the torso, such any other type of plastic.

The appendage 260 is disposed outside of the cavity 222 and is coupled to the torso 220 for relative pivotal movement between the appendage and the torso. In the illustrated embodiment, the appendage 260 includes a first opening 266 located on the top portion of the appendage (see FIGS. 9 and 12) and a second opening (not shown) that is located on the bottom portion of the appendage. Projections (not shown) that are coupled to the torso 220 engage with the openings 266 to pivotally couple the appendage 260 to the torso 220. In alternative embodiments other coupling mechanisms, such as brads, rivets, etc., are used to pivotally couple the appendage to the torso.

The toy reef fish 200 also includes a drive 240, which is housed within the cavity 222. The drive 240 is coupled to the torso 220 and to the appendage 260 of the toy reef fish 200. The drive 240 is configured to pivot the appendage 260 with respect to the torso 220 and thereby propel the toy reef fish though a liquid, such as water.

Figure 9:
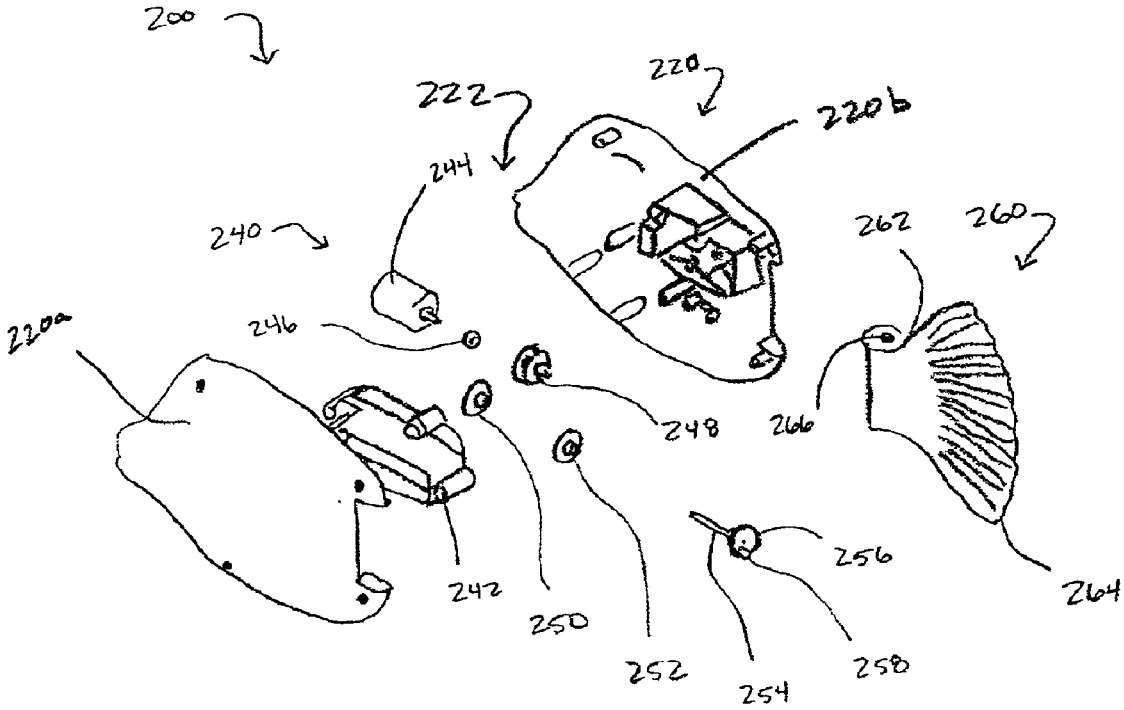
FIG. 9 is an exploded view of the toy reef fish of FIG. 8.
Figure 10:
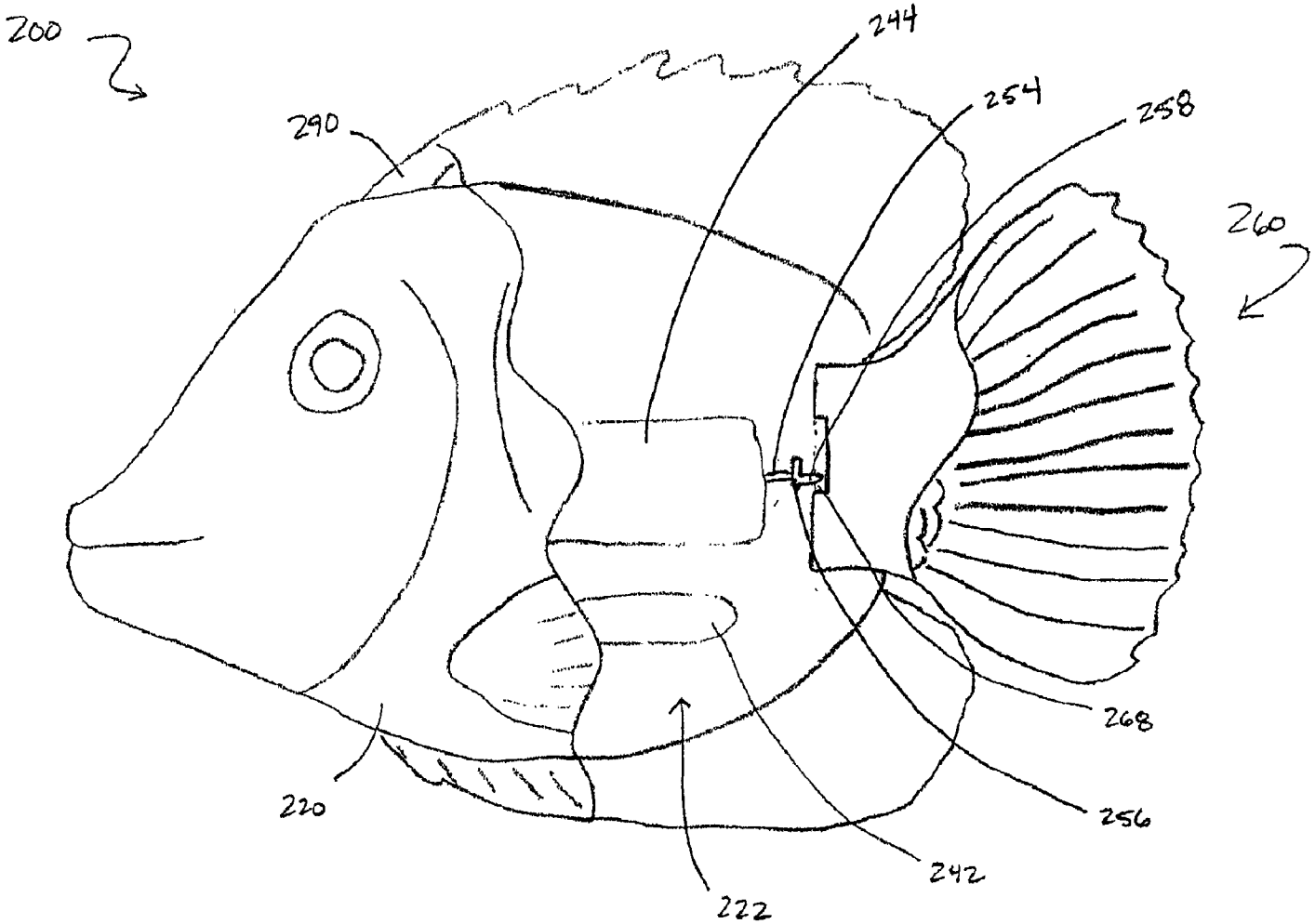
FIG. 10 is a cut-away side view of the toy reef fish of FIG. 8.
Figure 11:
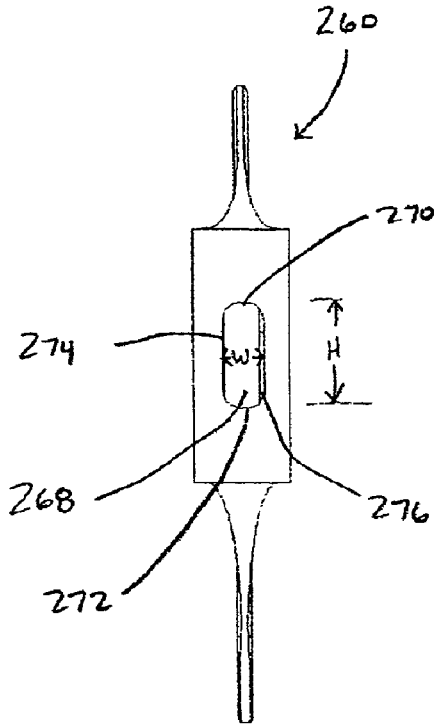
FIG. 11 is a front view of the tail of the toy reef fish of FIG. 8.
Figure 12:
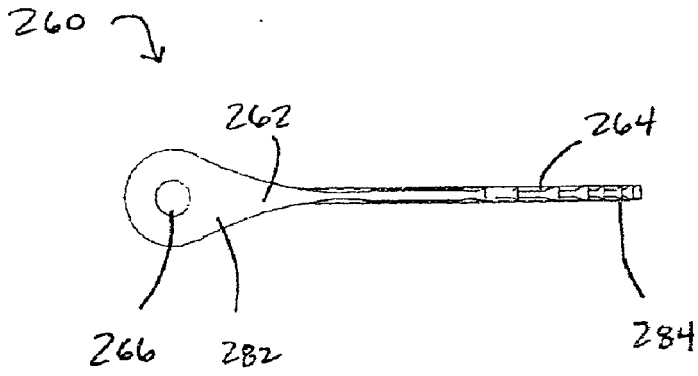
FIG. 12 is a top view of the tail of the toy reef fish of FIG. 8.

In the illustrated embodiment, the drive includes a power source 242 and a motor 244. The power source 242 can be a power source, such as a battery. The power source 242 is operatively coupled to the motor 244 to provide power to the motor. As illustrated in FIGS. 9 and 10, the drive 240 also includes a set of gears 246, 248, 250, and 252, a shaft 254, and a crank 256. The motor 244 is operatively coupled to the set of gears 246, 248, 250, and 252, the shaft 254, and the crank 256. When the motor 244 is activated, the motor operates to rotate these items.

Although the drive 240 is illustrated as being a battery powered motor, the drive need not be such a mechanism. In an alternative embodiment, the drive is a wind-up type motor, a spring biased gear rack, or any other mechanism that will produce a force sufficient to move the appendage 260 of the toy reef fish 200 with respect to the torso 220 of the toy reef fish. Additionally, although the drive 240 is illustrated as including several gears 246, 248, 250, and 252, any number of gears may be used in the drive.

The crank 256 includes a projection 258 that is offset from the center of the crank. Thus, when the crank 256 rotates, the projection 258 moves in a circular path. The projection 258 extends from the cavity 222 and engages a vertical slot 268 located on the front side of the appendage 260. In the illustrated embodiment, the height H of the slot 268 is greater than the diameter of the circle defined by the movement of the projection 258. The width W of the slot 268 is less than the diameter of the circle defined by the movement of the projection 258. Thus, as the projection 258 moves in its circular path, the projection will not contact the upper portion 270 or the lower portion 272 of the slot 268. The projection 258 will, however, contact the side portions 274 and 276 of the slot 268 as the projection moves in its circular path. The contact between the projection 258 and the side portions 274 and 276 of the slot 268 force the appendage 260 to move in a reciprocating pivotal motion with respect to the torso 220.

Similar to the above-described embodiments, the appendage 260 includes a rigid portion 262 and a flexible portion 264. The flexible portion 264 is configured to bend or flex when the toy reef fish 200 is placed in a liquid and the appendage 260 pivots with respect to the torso 220. Thus, the appendage 260 has substantially the same wave-like whipping motion that is described above and illustrated in FIGS. 3–7. In this embodiment, the pivoting motion combined with the bending and flexing of the flexible portion 264 of the appendage 260 provides the appendage with life-like fish tail movements.

The rigid portion 262 of the appendage 260 is located proximate to a front end 282 of the appendage. The flexible portion 264 of the appendage is located proximate to a rear end 284 of the appendage. In the illustrated embodiment, the appendage 260 has a tapered cross-section with the front end 282 of the appendage 260 being thicker than the rear end 284 of the appendage. In this embodiment, the appendage is made of a single type of flexible material, and the thickness of the material determines whether the particular portion of the appendage is rigid or flexible. The flexible material is rigid enough to retain the shape and form of the appendage, yet is flexible enough to bend and flex when the appendage 260 moves with respect to the torso 220.

The particular material from which the appendage is made can be selected so that the appendage maintains a life-like motion similar to that described above in FIGS. 3–7. More specifically, the particular material selected for the appendage depends on, at least in part, the specific shape of the appendage and the size of the self-propelled figure. For example, a thicker width appendage is made from a more flexible material than the material used to make a thinner width appendage. Similarly, a larger self-propelled figure will typically have an appendage with a less flexible material than the material used to make an appendage for a smaller self-propelled figure. In sum, an appendage for any given type of self-propelled figure can be made from a material having a shore A durometer hardness, for example, between substantially 10 and 70. For example, in one embodiment, the appendage of the toy reef fish 200 shown in FIGS. 8–12 is made of a polyvinyl chloride with a shore A durometer hardness in the range of 50 to 60. In another embodiment, the appendage is made of a polyvinyl chloride with a shore A durometer hardness of 50.

In an alternative embodiment, the appendage does not have a tapered cross-section, and the rigid portion and the flexible portion of the appendage are made of different types of materials. The particular hardness of those different types of materials can be selected from shore A durometer hardness in the range of 10 to 70.

In the illustrated embodiment, the toy reef fish 200 is configured to be substantially neutrally buoyant. Thus, when the toy reef fish 200 is placed in water, the toy reef fish remains near the surface of the water but vacillates between being entirely submerged in the water and being only partially submerged in the water. In another embodiment, the toy reef fish is configured to be substantially negatively buoyant so that the fish sinks when the it is placed in water. In a further embodiment, the toy reef fish is configured to be substantially positively buoyant so that the fish floats when it is placed in water.

In the illustrated embodiment, the toy reef fish 200 also includes a top fin 290, a bottom fin 292, and side fins 294 (only one shown). In one embodiment, the fins 290, 292, and 294 are made of a polyvinyl chloride with a shore A durometer hardness of 50. In an another embodiment, the fins 290, 292, 294, and 296 are made of a polyvinyl chloride with a shore A durometer hardness in the range of 50 to 60. In alternative embodiments, the toy reef fish includes any combination of the fins. For example, in one embodiment the toy reef fish includes only a top fin. In another embodiment, the toy reef fish includes a top fin and a bottom fin.

Figure 13:
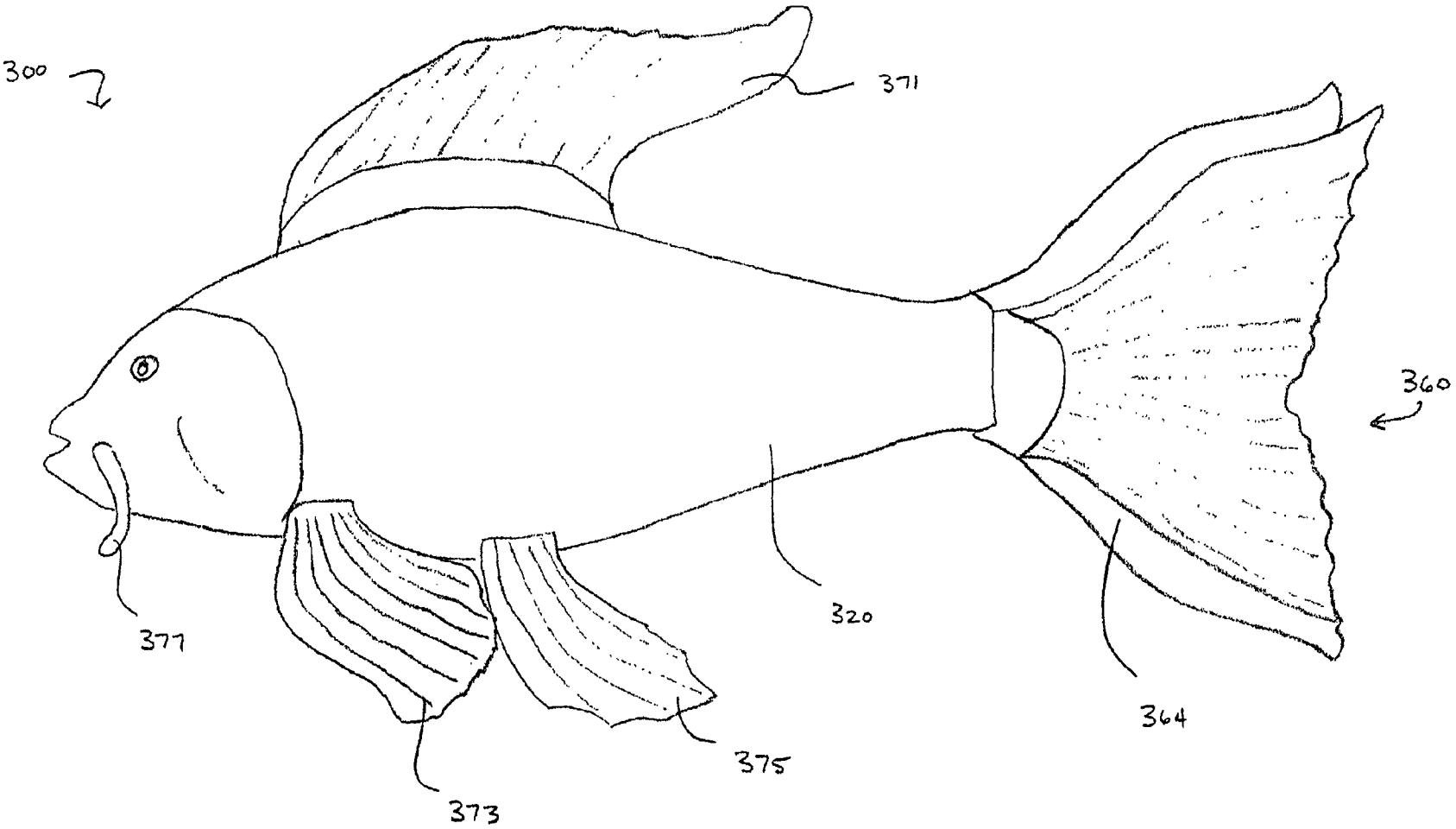
FIG. 13 is a side view of a toy koi fish according to an embodiment of the present invention.

FIG. 13 illustrates a second implementation of the present invention. In this embodiment, a toy koi fish 300 includes a torso 320 that simulates the torso of a koi fish and an appendage 360 that simulates a tail of a koi fish. The toy koi fish also includes a drive (not shown) that is coupled to the torso 320 and to the appendage 360. The torso 320, the appendage 360, and the drive can be structurally and functionally equivalent to the torso, appendage, and drive described in toy reef fish embodiment.

The toy koi fish 300 can function in a manner that is substantially similar to the manner in which the toy reef fish functions. The drive is configured to produce reciprocating pivotal motion between the appendage 360 and the torso 320. When the toy koi fish 300 is placed in a liquid, such as water, and the appendage 360 pivots with respect to the torso 320 a flexible portion 364 of the appendage 360 flexes and bends to produce a wave-like whipping motion substantially similar to the wave-like whipping motion described in the above embodiments. The pivotal motion and the whipping motion effectively propel the toy koi fish 300 through the water and provide the appendage 360 with life-like fish tail movements.

Similar to the toy reef fish embodiment, the toy koi fish 300 can be configured to be substantially neutrally buoyant. Thus, when the toy koi fish 300 is placed in water, the toy koi fish remains near the surface of the water but vacillates between being entirely submerged in the water and being only partially submerged in the water. In another embodiment, the toy koi fish is configured to be negatively buoyant so that the toy koi fish sinks when the toy koi fish is placed in water. In a further embodiment, the toy koi fish is configured to be positively buoyant so that the toy koi fish floats when the toy koi fish is placed in water.

Although in the illustrated embodiment, the toy koi fish 300 includes a top fin 371, small bottom fins 373 (only one shown), large bottom fins 375 (only one shown), and whiskers 377 (only one shown), it is not necessary that the toy koi fish include these items. In this embodiment, the top fin 371, the small bottom fins 373, the large bottom fins 375, and the whiskers 377 are made of a flexible material, such as a polyvinyl chloride with a shore A durometer hardness in the range of 50 to 60. Alternatively, the fins and the whiskers are made of a rigid material, such as plastic.

Figure 14:
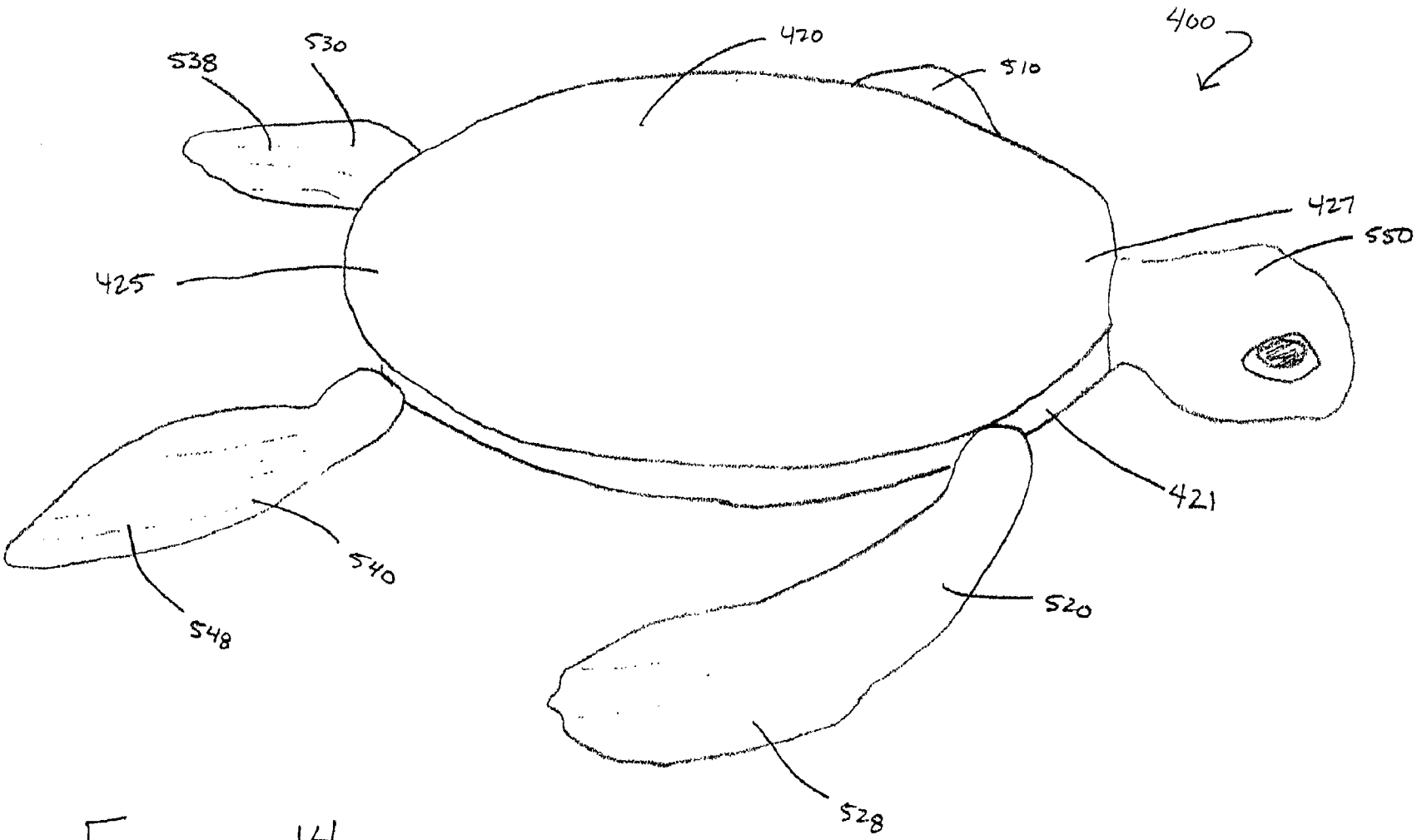
FIG. 14 is a perspective view of a toy turtle according to an embodiment of the present invention.
Figure 15:
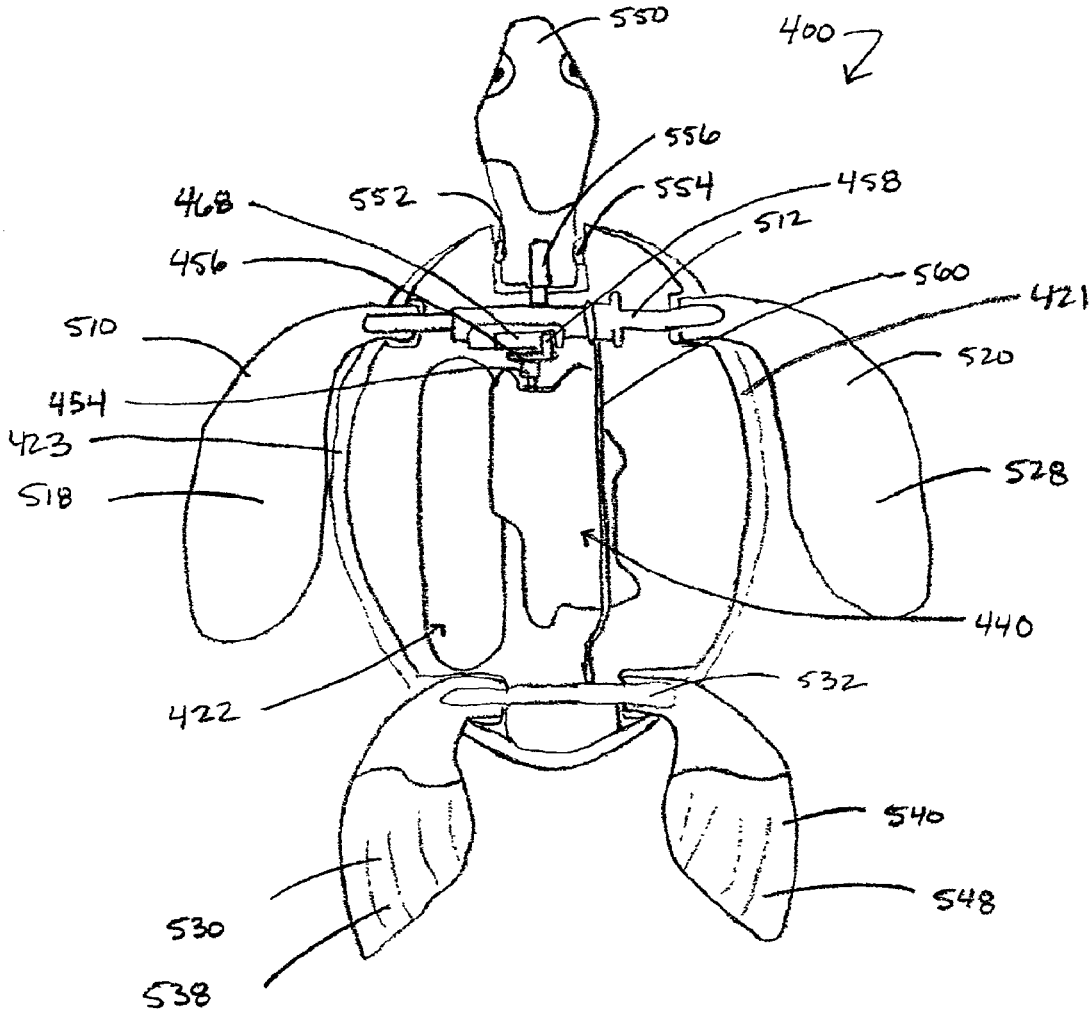
FIG. 15 is a cut-away top view of the toy turtle of FIG. 14.
Figure 16:
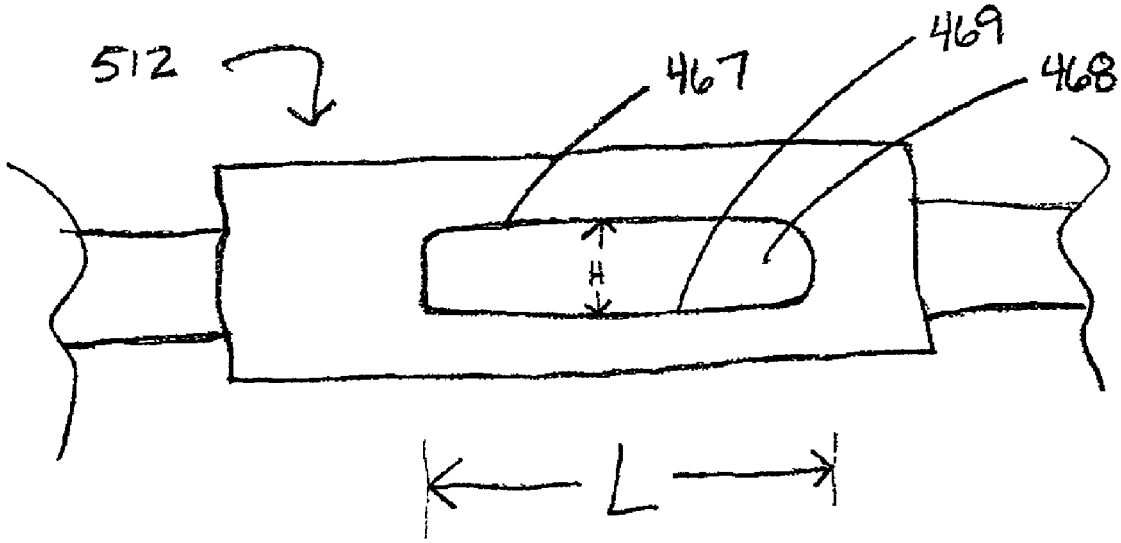
FIG. 16 is a side view of an axle of the toy turtle of FIG. 14.

FIGS. 14–16 illustrate a third implementation of the present invention. In this embodiment, a toy turtle 400 includes a torso 420 that is configured to simulate a body of a turtle, arm appendages 510 and 520 that are configured to simulate arms of a turtle, leg appendages 530 and 540 that are configured to simulate legs of a turtle, and a head appendage 550 that is configured to simulate a head of a turtle. The torso 420 of the toy turtle 400 includes a front portion 427, a rear portion 425, and side portions 421 and 423. The outer surface of the torso 420 defines an enclosure or cavity 422.

The arm appendages 510 and 520, the leg appendages 530 and 540, and the head appendage 550 are disposed outside of the enclosure or cavity 422 and are pivotally coupled to the torso 420. In the illustrated embodiment, the arm appendages 510 and 520 are coupled to a front axle 512 that extends though the torso 420 and is pivotally coupled to the torso. Similarly, the leg appendages 530 and 540 are coupled to a rear axle 532 that extends through the torso 420 and is pivotally coupled to the torso. In the illustrated embodiment ends of each of the axles 512 and 532 are disposed within a portion of the appendages 510, 520, 530, and 540 to couple the appendages to the axles. In another embodiment another mechanism, such as an adhesive, is used to couple the appendages to the respective axles.

The torso includes projections 552 and 554 that communicate with the openings on the side of the head appendage 550 to pivotally couple the head appendage to the torso 420. In another embodiment, another method is used to pivotally couple the head appendage to the torso of the turtle.

The toy turtle 400 also includes a drive 440 that includes a power source 442, a motor (not shown), a shaft 454, and a crank 456. The drive 440 is structurally and functionally equivalent to the drive described in the toy reef fish embodiment. However, in an alternative embodiment the drive is a wind-up type motor, a spring biased gear rack, or any other type of mechanism that would produce forces sufficient to move the appendages with respect to the torso.

Similar to the above-described embodiments, the crank 456 includes a projection 458 that is offset from the center of the crank. Thus, when the crank 456 is rotated by the motor, the projection moves in a circular path. As best viewed in FIGS. 15 and 16, the projection 458 communicates with a slot 468 located on axle 512. The length L of the slot 468 is greater than the diameter of the circle defined by the movement of the projection 458. The height H of the slot 468 is less than the diameter of the circle defined by the movement of the projection 458. Thus, as the crank 456 rotates and the projection 458 moves in its circular path, the projection 458 contacts the upper side portion 467 and the lower side portion 469 of the slot 468. The contact between the projection 458 and the side portions 467 and 469 force the axle 512 to move in a reciprocating pivotal motion with respect to the torso 420.

Axle 512 is coupled to the head appendage 550 via a linkage 556 and to axle 532 via a linkage 560. Thus, as axle 512 is pivoted, the head appendage 550 is also pivoted with respect to the torso 420 about an axis of rotation defined by the projections 552 and 554. Similarly, as axle 512 pivots with respect to the torso 420, axle 532 also pivots with respect to the torso.

As the axles 512 and 532 pivot with respect to the torso 420, the arm and leg appendages 510, 520, 530, and 540 also pivot with respect to the torso. Similar to the above described embodiments, the arm appendages 510 and 520 and the leg appendages 530 and 540 include flexible portions 518, 528, 538, and 548. The flexible portions 518, 528, 538, and 548 flex and bend when the toy turtle 400 is placed in a liquid, such as, water and the appendages 510, 520, 530, 540, respectively, pivot with respect to the torso 420 to produce the substantially the same wave-like whipping motion that is described above and illustrated in FIGS. 3–7. The pivoting motion and the flexing of the flexible portions 518, 528, 538, and 548 of the appendages 510, 520, 530, and 540, respectively, propel the toy turtle 400 through the liquid and provide the appendages with life-like turtle arm and leg movements.

The flexible portion 518, 528, 538, and 548 of the appendages 510, 520, 530, and 540, respectively, can be made of any type of flexible material. In the illustrated embodiment the appendages 510, 520, 530, and 540 are made of a polyvinyl chloride with a shore B durometer hardness in the range of 40 to 50.

In this embodiment, the head appendage 550 of the toy turtle 400 is made of a rigid material, such as a molded polyvinyl chloride. In another embodiment, the head appendage is made of a flexible material, such as a polyvinyl chloride with a shore A durometer hardness of 40 to 50.

In the illustrated embodiment, toy turtle 400 is configured to float when the it is placed in water. In another embodiment, the toy turtle is substantially neutrally buoyant. In another embodiment, the toy turtle is configured to sink when placed in water. In a further embodiment, the toy turtle is configured to be suspended at a range of depths when the toy turtle is placed in water.

Other embodiments of the invention are contemplated. The figure can simulate, for example, virtually any animal, human, or action figure. The appendage can be any appendage appropriate to the selected torso, including a leg, a tail, an arm, a head, or another body segment.

While the invention has been described in detail and with reference to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents.

What is claimed is:

1. A figure, comprising:

a torso;

a first appendage coupled to said torso, said first appendage being made of a polyvinyl chloride having a shore A durometer hardness of substantially 10 to 70, said first appendage having a first end pivotally coupled to said torso;

a drive coupled to said torso and to said first appendage, said drive configured to move said first appendage with respect to said torso, said first appendage being configured to flex into a non-planar configuration in response to said drive moving said first appendage with respect to said torso;

a second appendage coupled to said torso, said second appendage being made of a polyvinyl chloride having a shore A durometer hardness of substantially 40 to 60; and a third appendage coupled to said torso, said third appendage being made of a polyvinyl chloride having a shore A durometer hardness of substantially 40 to 60, wherein said second appendage and said third appendage are coupled to said drive, said drive being configured to move said second appendage and said third appendage with respect to said torso.

2. The figure of claim 1, wherein said first appendage is made of a polyvinyl chloride having a shore A durometer hardness of 40 to 60.

3. The figure of claim 1, wherein when said drive moves said first appendage with respect to said torso, said first appendage flexes in a direction opposite to that of the motion of said first appendage during at least a portion of the entire range of motion of the first appendage, the motion and the flex of said first appendage causing said first appendage to move in a wave-like, whipping motion.

4. The figure of claim 1, wherein said torso simulates a torso of a turtle and at least one of said first appendage, said second appendage, and said third appendage simulates one from the group of an arm of a turtle and a leg of a turtle.

5. The figure of claim 1, wherein said first appendage includes:

a second end, said first appendage including a tapered cross-section, with the first end having a thickness greater than a thickness of the second end, and the second end having a greater flexibility than the first end.

6. The figure of claim 1, wherein the figure is configured to be substantially neutrally buoyant.

7. The figure of claim 1, wherein at least one of said first appendage, said second appendage, and said third appendage is configured to propel the figure through a liquid.

8. A figure configured to be at least partially immersed in and propelled through a liquid, said figure comprising:

a torso defining a cavity, said torso simulating an figure torso;

a first appendage disposed outside of the cavity and coupled to said torso, said first appendage configured to propel the figure through the liquid;

a second appendage coupled to said torso;

a third appendage coupled to said torso; and a drive coupled to said torso and to said first appendage, said drive configured to produce forces on said torso and on said first appendage sufficient to produce cyclical relative motion between said first appendage and said torso when the figure is at least partially immersed in the liquid, said first appendage being configured to flex in response to said drive producing the relative motion, said drive being coupled to said second appendage and said third appendage, said drive being configured to produce forces on said torso and on said second appendage sufficient to move said second appendage with respect to said torso, said drive being configured to produces forces on said torso and on said third appendage sufficient to move said third appendage with respect to said torso.

9. The figure of claim 8, wherein said torso has an outer surface, the outer surface of the torso defines the cavity.

10. The figure of claim 8, wherein said torso defines an outer surface, said first appendage includes:

a first end coupled to said torso along the outer surface of said torso; and a second end, said first appendage having a tapered cross-section, with the first end having a greater thickness than the second end and the second end having a greater flexibility than the first end.

11. The figure of claim 8, wherein the cyclical relative motion is a reciprocating pivotal motion, when the drive produces the reciprocating pivotal motion, said first appendage flexes in a direction opposite to that of the motion of said first appendage during at least a portion of the reciprocating pivotal motion, the flex of the first appendage and the reciprocating pivotal motion cause said first appendage to have a wave-like, whipping motion.

12. The figure of claim 8, wherein said torso simulates a torso of a turtle, at least one of said first appendage, said second appendage, and said third appendage simulates one from the group of an arm of a turtle and a leg of a turtle.

13. The figure of claim 8, wherein said torso simulates a torso of a turtle, said first appendage simulates one from the group of an arm of the turtle and a leg of the turtle, said second appendage simulates one from the group of an arm of the turtle and a leg of the turtle, said third appendage simulates one from the group of an arm of the turtle, a leg of the turtle, and a head of the turtle.

14. The figure of claim 8, said torso having a front portion, a rear portion, and side portions, at least one of said first appendage, said second appendage, and said third appendage being coupled to a side portion of said torso.

15. The figure of claim 8, wherein at least one of said first appendage, said second appendage, and said third appendage is made of a polyvinyl chloride having a shore A durometer hardness of 10 to 70.

16. The figure of claim 8, wherein at least one of said first appendage, said second appendage, and said third appendage is made of a polyvinyl chloride having a shore A durometer hardness of substantially 40 to 60.

17. The figure of claim 8, wherein the figure is configured to be substantially neutrally buoyant.

18. A simulated turtle, comprising:

a torso configured as a turtle torso;

a first flexible appendage coupled to said torso, said first appendage simulating one from the group of an arm of a turtle and a leg of a turtle;

a second flexible appendage coupled to said torso, said second appendage simulating one from the group of an arm of a turtle and a leg of a turtle;

a third flexible appendage coupled to said torso, said third appendage simulating one from the group of an arm of a turtle, a leg of a turtle, and a head of a turtle; and a drive coupled to said torso, to said first appendage, to said second appendage, and to said third appendage, said drive configured to move said first appendage, said second appendage, and said third appendage with respect to said torso when the simulated turtle is at least partially immersed in a liquid, said appendages being configured to flex when said drive moves said appendages.

19. The simulated turtle of claim 18, wherein said first appendage, said second appendage, and said third appendage are made of a polyvinyl chloride having a shore A durometer hardness of substantially 40 to 50.

20. The simulated turtle of claim 18, wherein the flex of said appendages and the motion of said appendages with respect to said torso cause the appendages to have a wave-like whipping motion.

21. The simulated turtle of claim 18, further comprising:

a fourth appendage coupled to said torso, said forth appendage simulating one from the group of an arm and a leg of a turtle, the drive coupled to said fourth appendage and configured to move said fourth appendage with respect to said torso when the turtle is at least partially immersed in a liquid.

22. A figure configured to be at least partially immersed in and propelled through water, said figure comprising:

a torso simulating an animal torso and defining a cavity;

a flexible appendage disposed outside of said cavity and coupled at a first end to said torso, said appendage having a tapered cross-section, with the first end having a greater thickness than a second end and the second end having a greater flexibility than the first end; and a drive coupled to said torso and to said appendage, said drive being configured to produce forces on said torso and on said appendage sufficient to produce reciprocating pivotal motion between said appendage and said torso when the figure is at least partially immersed in the water, said appendage being configured to flex in a direction opposite to that of the motion of said appendage during at least a portion of the reciprocating pivotal motion, the flex of the appendage and the reciprocating pivotal motion cause said appendage to have a wave-like, whipping motion, said appendage being made of a polyvinyl chloride having a shore A durometer hardness of 10 to 70.

23. The figure of claim 22, wherein said torso simulates a fish torso, said appendage simulates a fish tail.

24. The figure of claim 22, wherein said torso simulates a turtle torso, said appendage simulates one from the group of an arm of the turtle and a leg of the turtle.

25. The figure of claim 22, wherein said appendage is made of a polyvinyl chloride having a shore A durometer hardness of 40 to 60.

26. A figure, comprising:

a torso;

an appendage coupled to said torso; and a drive coupled to said torso and to said appendage, said drive configured to move said appendage with respect to said torso, the figure being configured to be substantially neutrally buoyant so that, when propelled through a liquid, the figure remains near the surface of the liquid vacillating between being entirely submerged and partially submerged in the liquid.

27. The figure of claim 26, wherein said torso simulates a fish and said appendage simulates a tail of a fish when said drive moves said appendage with respect to said torso.

28. The figure of claim 26, wherein said appendage is made of a polyvinyl chloride having a shore A durometer hardness of 40 to 60.

29. The figure of claim 26, wherein when said drive moves said appendage with respect to said torso, said appendage flexes in a direction opposite to that of the motion of said appendage during at least a portion of the entire range of motion of the appendage, the motion and the flex of said appendage causing said appendage to move in a wave-like, whipping motion.

30. The figure of claim 26, wherein said appendage includes:

a first end pivotally coupled to said torso; and a second end, said appendage including a tapered cross-section, with the first end having a thickness greater than a thickness of the second end, and the second end having a greater flexibility than the first end.

31. A figure configured to be at least partially immersed in and propelled through a liquid, said figure comprising:

a torso defining a cavity, said torso simulating an figure torso;

a flexible appendage disposed outside of the cavity and coupled to said torso, said appendage configured to propel the figure through the liquid; and a drive coupled to said torso and to said appendage, said drive configured to produce forces on said torso and on said appendage sufficient to produce cyclical relative motion between said appendage and said torso when the figure is at least partially immersed in the liquid, said appendage being configured to flex in response to said drive producing the relative motion, said appendage being configured to flex into a non-planar configuration in response to said drive producing the relative motion.

32. The figure of claim 31, wherein said torso has an outer surface, the outer surface of the torso defines the cavity.

33. The figure of claim 31, wherein said torso defines an outer surface, said appendage includes:

a first end coupled to said torso along the outer surface of said torso; and a second end, said appendage having a tapered cross-section, with the first end having a greater thickness than the second end and the second end having a greater flexibility than the first end.

34. The figure of claim 31, wherein the cyclical relative motion is a reciprocating pivotal motion, when the drive produces the reciprocating pivotal motion, said appendage flexes in a direction opposite to that of the motion of said appendage during at least a portion of the reciprocating pivotal motion, the flex of the appendage and the reciprocating pivotal motion cause said appendage to have a wave-like, whipping motion.

35. The figure of claim 31, wherein said torso simulates a torso of a fish, and said appendage simulates a tail of a fish.

36. The figure of claim 31, wherein said appendage is made of a polyvinyl chloride having a shore A durometer hardness of 10 to 70.

37. The figure of claim 31, wherein said appendage is made of a polyvinyl chloride having a shore A durometer hardness of substantially 40 to 60.

38. The figure of claim 31, wherein the figure is configured to be substantially neutrally buoyant.

39. The figure of claim 31, wherein the figure is configured to be substantially neutrally buoyant so that, when propelled through a liquid, the figure remains near the surface of the liquid vacillating between being entirely submerged and partially submerged in the liquid.

* * * * *